US007156036B2

(12) United States Patent
Seiple

(10) Patent No.: US 7,156,036 B2
(45) Date of Patent: Jan. 2, 2007

(54) LAUNCH AND RECOVERY SYSTEM

(76) Inventor: Ronald L. Seiple, 1063 Koohoo Pl., Kailua, HI (US) 96734

( * ) Notice: Subject to any disclaimer, the term of this patent is extended or adjusted under 35 U.S.C. 154(b) by 0 days.

(21) Appl. No.: 11/409,000

(22) Filed: Apr. 24, 2006

(65) Prior Publication Data

US 2006/0254491 A1 Nov. 16, 2006

Related U.S. Application Data

(60) Provisional application No. 60/680,312, filed on May 13, 2005.

(51) Int. Cl.
*B63B 21/16* (2006.01)

(52) U.S. Cl. ..... 114/254; 114/259

(58) Field of Classification Search ..... 114/253, 114/254, 258, 259

See application file for complete search history.

(56) References Cited

U.S. PATENT DOCUMENTS

| | | | | |
|---|---|---|---|---|
| 237,262 | A * | 2/1881 | Estep | 440/34 |
| 2,398,274 | A | 4/1946 | Albert | |
| 3,937,163 | A | 2/1976 | Rosenberg | |
| 3,943,875 | A | 3/1976 | Sanders | |
| 4,000,533 | A | 1/1977 | Higgs | |
| 4,406,244 | A | 9/1983 | Buchan et al. | |
| 4,676,183 | A * | 6/1987 | Conboy | 114/245 |
| 5,178,090 | A * | 1/1993 | Carter | 114/315 |
| 5,192,238 | A | 3/1993 | Brown | |
| 5,253,605 | A | 10/1993 | Collins | |
| 6,003,463 | A * | 12/1999 | Giesler | 114/259 |
| 6,145,462 | A * | 11/2000 | Aquino | 114/253 |
| 6,178,914 | B1 | 1/2001 | Axelsson | |
| 6,390,012 | B1 | 5/2002 | Watt et al. | |
| 6,431,105 | B1 | 8/2002 | Haram | |
| 6,698,376 | B1 | 3/2004 | Delahousse et al. | |
| 6,779,475 | B1 | 8/2004 | Crane et al. | |
| 6,840,188 | B1 | 1/2005 | Witbeck | |
| 6,883,453 | B1 * | 4/2005 | Mulhern | 114/253 |
| 2004/0229531 | A1 | 11/2004 | Driscoll et al. | |
| 2005/0257731 | A1 | 11/2005 | Bouchaud et al. | |

FOREIGN PATENT DOCUMENTS

| | | |
|---|---|---|
| JP | 52-106593 | 9/1977 |
| JP | 62-8888 | 1/1987 |
| WO | WO 97/29012 | 8/1997 |

OTHER PUBLICATIONS

REEMUS Launch and Recovery System (LARS) http://www.hydroidine.com/LARS.html Retrieved on Mar. 13, 2006.
ROV Launch & Recovery Crane http://www.calzonispa.com/NAV/prodotti/crane.htm Retrieved on Mar. 13, 2006.

* cited by examiner

*Primary Examiner*—Stephen Avila
(74) *Attorney, Agent, or Firm*—Richard C. Litman

(57) ABSTRACT

The launch and recovery system provides a dive wing and drogue assembly that is towed behind a ship by cables. The dive wing imparts a downward thrust to the drogue, so that the drogue is towed underwater, placing tension on the cables. The cables become stiff due to the speed of the ship and the weight and depth of the dive wing and drogue assembly, so that the cables take on the character of rails. The boat or watercraft to be launched is placed on a sling carriage that is slidably mounted on the cables, so that the sling slides down the cables, launching the watercraft in the stable wake of the ship. The watercraft is recovered by tying a winch cable or line to the watercraft, winching the watercraft back onto the sling, and winching the sling back onto the fantail of the ship.

11 Claims, 6 Drawing Sheets

LAUNCH AND RECOVERY SYSTEM

CROSS-REFERENCE TO RELATED APPLICATION

This application claims the benefit of U.S. Provisional Patent Application Ser. No. 60/680,312, filed May 13, 2005.

BACKGROUND OF THE INVENTION

1. Field of the Invention

The present invention relates to a method for launching and recovering watercraft, and particularly to a launch and recovery system for launching watercraft from, and recovering the watercraft to, a boat or ship while the boat or ship is underway.

2. Description of the Related Art

For many years, it has been a requirement to stop a ship dead in the water (DIW) to launch watercraft at sea. However, stopping the ship dead in the water causes increased motion as a ship begins to roll in the wave trough while losing underway status. Typically, ships use davits or cranes to deploy watercraft over the ship sides using cable lines, blocks and tackles. When the watercraft are being raised or lowered in the aforementioned manner, motion of the ship is amplified and correspondingly increases the swing of the watercraft as it is suspended from the davits.

In rough seas, launching and recovery operations using the aforementioned method becomes more difficult and dangerous. Efforts have been made to develop motion compensation systems for DIW launch and recovery operations, but such compensation systems have not been able to compensate for decreased ship stability during a DIW launch or recovery attempt.

When a ship remains underway it is much more stable than in the aforementioned DIW status. Stern wave action is substantially reduced by the ship as it displaces the sea. For example, water skiers and the like are known to move into the flat area of calm sea to the rear of a pulling craft to take advantage of this effect. Similarly, it would be desirable to have a launch system capable of deploying a watercraft into the flat area "sweet spot" behind the ship.

During combat, interdiction and coastal patrol ships can easily lose their enemy by having to stop or even slow in order to launch boarding craft, and vessels launching scouting or raiding parties can become exposed to defensive fire by losing headway while making a launch or recovery. Having the ability to launch such craft safely while underway and still at speed could prove extremely valuable in many such operations at sea.

Moreover, at sea, rescue operations for seamen or passengers who have fallen overboard are very difficult. A ship is generally required to go DIW to launch a rescue craft with current techniques, which can take considerable time and distance in many instances. Thus, using related art techniques for launch and recovery, a ship's captain executes a special turn known as a "Williamson Turn" in order to return to the overboard personnel. With aids such as global positioning systems, the location can be accurately determined, but the maneuver can take so much time that a single person lost overboard can still be difficult to locate and especially in strong currents, high waves, etc. Cruise ships may be particularly susceptible to losing passengers who have fallen overboard due to the time required to turn around, get back on course, slow down, and launch a recovery boat. The ability to launch a recovery craft immediately while still underway may therefore prove to be a great benefit to rescue operations.

Traditionally, most small boat launches are done over the lee side of the ship. While combat craft have been experimenting with stern launching from ramps in recent years, nevertheless, the ship must still slow down to launch from a ramp. It remains true that the ship is most stable while underway, and the smoothest place near a ship is aft of the ship where the ship has smoothed out the surface wave action by its shear size moving through the ocean.

Thus, a launch and recovery system for launching a watercraft from a ship while still underway solving the aforementioned problems is desired.

SUMMARY OF THE INVENTION

The launch and recovery system provides a dive wing and drogue assembly that is towed behind a ship by cables. The dive wing imparts a downward thrust to the drogue, so that the drogue is towed at a consistent depth underwater, placing tension on the cables. The cables become stiff due to the speed of the ship and the weight and depth of the dive wing and drogue assembly, so that the cables take on the character of rails. The boat, watercraft, or other payload to be launched is placed on a sling carriage that is slidably mounted on the cables, so that the sling slides down the cables, launching the watercraft in the stable wake of the ship. The watercraft is recovered by tying a winch cable or line to the watercraft, winching the watercraft back onto the sling, and winching the sling back onto the fantail of the ship.

The system may be modified to use a single tow cable, which tows a pair of drogues. The drogues are towed by separate lines attached to a yoke at the end of the single cable at a point calculated to be just before entry into the water during launch, so that the vessel being launched is clear of the single cable upon entry into the water.

The launch and recovery system may be used to launch manned craft of various sizes, unmanned undersea vessels, mine hunting vehicles, emergency rescue craft, and other types of payload. The system may be deployed for military purposes, for commercial enterprises, and for emergency rescue work for cruise ships, fishing trawlers, merchant ships, and the like.

In some instances where the cable angle is insufficient for a gravity launch, a secondary drogue device can be used to assist the deployment process.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1A:
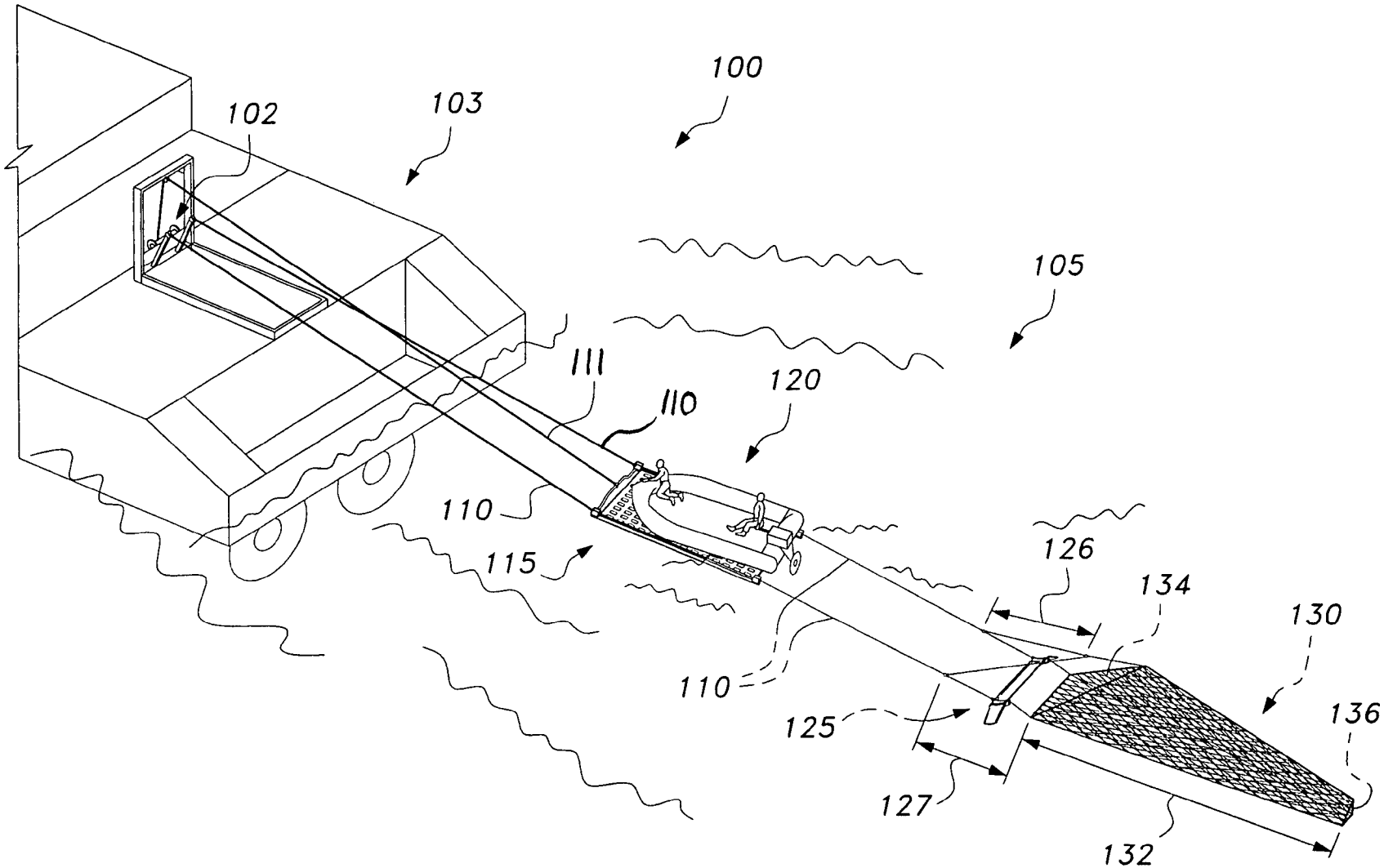
FIG. 1A is an environmental perspective view of a boat launch and recovery system according to the present invention.

As shown in FIG. 1A, the present invention is a launch and recovery system, designated generally as 105 in the drawings. The system includes a dive wing and drogue assembly, including dive wing 125 and drogue 130, which may be deployed from the stern or other region of a ship 103 or boat by cables 110 (a dual cable system is shown in FIG. 1A, a single cable system being described below). A sling carriage 115 is slidably mounted on the cables 110. A boat 120, craft, or other payload to be launched is supported above, between, or below the cables 110 on the sling carriage 115. Cables 110 are played out from split or dual drum winches on the fantail until the dive wing 125 and drogue 130 reach the desired depth and angle to tension cables 110 and provide a safe angle of entry of the boat 120 into the water. A sling recovery line 111 is attached to the sling carriage 115, and is used to haul the sling carriage 115 back onboard after launch of the boat 120 using winch 102. The split drum winches retrieve the cables 110, dive wing 125, and drogue 130 after launch.

The system may be modified to a single cable system for launching smaller watercraft or other payload. In a single cable system, a single tow cable 110 tows a pair of small drogues. The drogues are towed by separate lines attached to a yoke at the end of the single cable 110 at a point calculated to be just before entry into the water during launch, so that the vessel being launched is clear of the single cable 110 upon entry into the water. Floats may be used to maintain constant drogue depth.

The drogue 130 is a modified trawl-type net composed of a robust, resilient material that can be easily repaired aboard ship. A wide variety of polymeric, elastomeric, or thermoplastic materials, e.g., nylon or Dacron, may be used as material for construction of the drogue 130. Accordingly, the drogue 130 may be repaired, i.e., by suturing and the like. This may cause some distortion in its shape, but the drogue 130 will still remain hydrodynamically effective as a stable drogue.

Figure 1B:
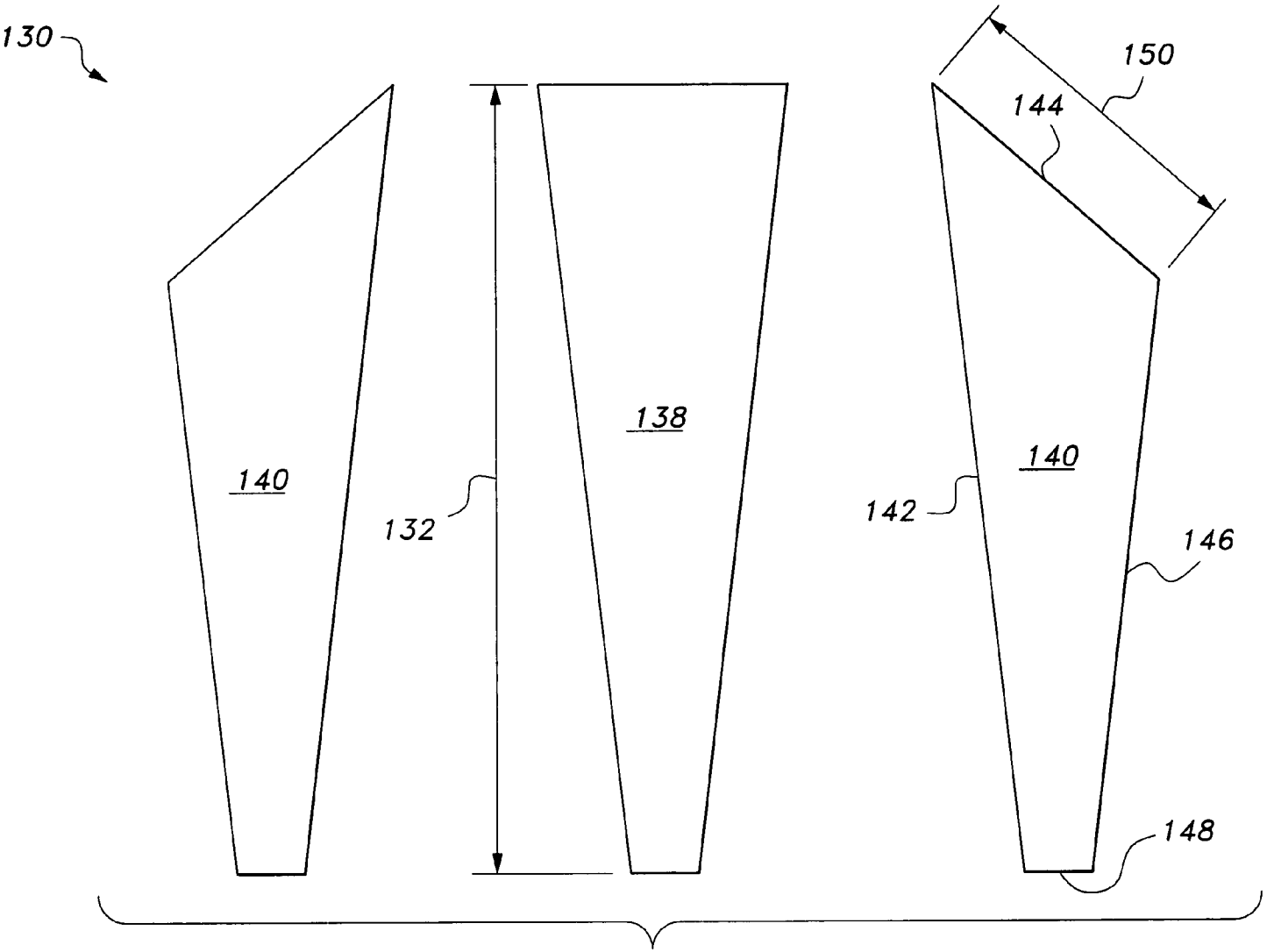
FIG. 1B is an exploded top plan view of a drogue chute in the boat launch and recovery system according to the present invention.
Figure 2:
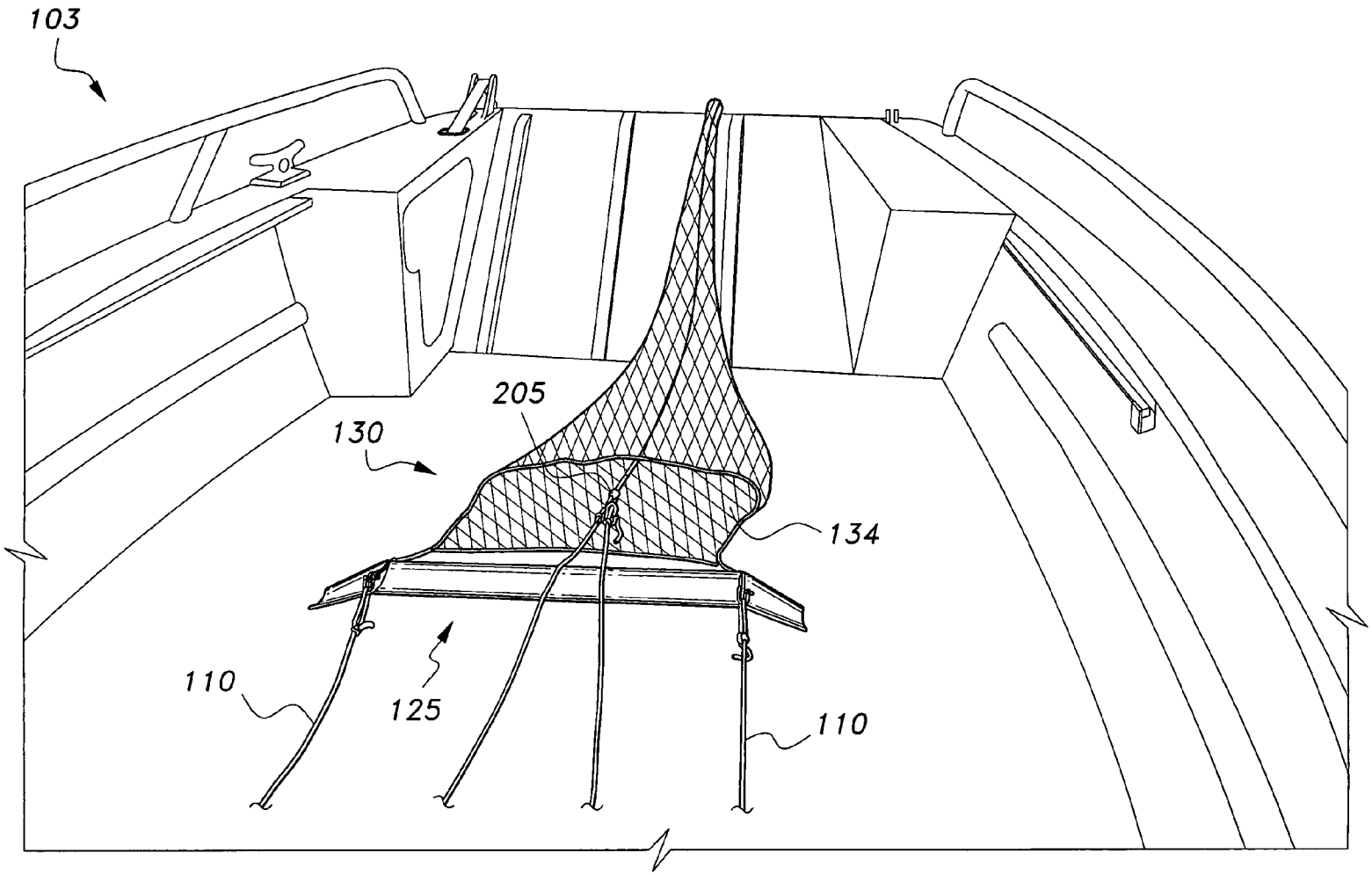
FIG. 2 is an environmental perspective view of the dive wing and drogue assembly of the boat launch and recovery system of the present invention.

As shown in FIGS. 1A, 1B, and 2, the drogue 130 has a front opening 134 and a rear opening 136, the openings being provided by joining a bottom net 138, which may be trapezoidal in shape, to preferably two lateral or side nets, each lateral net 140 comprising a bottom net attachment edge 142, a leading edge 144, a top edge 146, and a trailing edge 148. Preferably, the leading edge 144 of lateral side 140 is swept back towards the rear of the drogue 130.

Additionally, the lateral nets 140 are preferably of the same shape and dimension. The symmetrical design of the lateral nets 140 provides a symmetrical hydrodynamic drag force that advantageously limits oscillations of the drogue 130 during high-speed towing. For ease of use, a netted, mesh design of the drogue 130 is provided so that the drogue 130 may readily dump water and collapse when being hauled out of the water.

Preferably the front opening or mouth of the drogue is approximately three square meters or less to produce the required drag force.

Thus, according to the present invention, the limited mouth opening is too small to catch most marine creatures. Additionally, the opening at the aft end of drogue 130 is approximately one square meter to further limit any retention of marine life within the drogue 130. The drogue 130 preferably has an upward sloping side to deter marine animals from entering the drogue 130.

Drogue dimensions may be scaled to fit a particular launch application. However, a ratio of the length 150 of leading edge 144 to the over all length 132 of the drogue 130 is preferably approximately 0.3828.

Figures 3A, 3B:
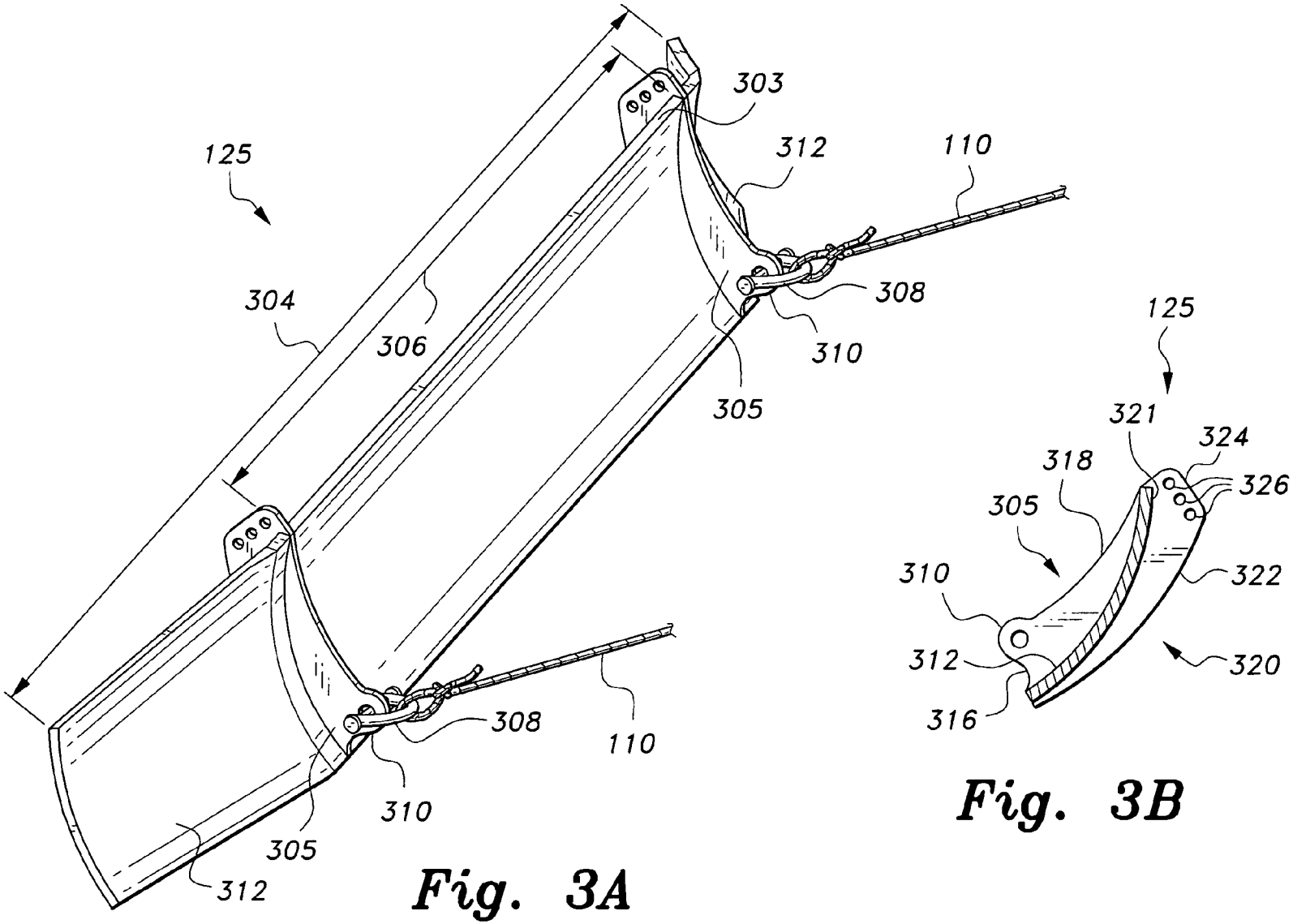
FIG. 3A is a detailed perspective view of the dive wing of a boat launch and recovery system according to the present invention.
FIG. 3B is a side view of the dive wing of FIG. 3A, depicting drogue and cable attachment points.

As shown in FIGS. 3A and 3B, the dive wing 125 is a concave foil including an intermediate component having an intermediate length 306 that laterally spans the bottom corners of the drogue 130 when attached to the drogue 130. Lateral ends of the concave foil are folded back to form keels 312. Preferably the fold back angle is approximately 20°.

Keels 312 are preferably identical in shape and dimension. Each keel 312 may have a tapered trailing edge. Overall span 304 of the dive wing 125 may be scaled to suit a particular application; however a ratio of overall span 304 to intermediate length 306 is preferably approximately 1.336 to 1. The dive wing 125 may be made of iron, steel, or any other durable, non-buoyant material without regard for minimizing the weight of dive wing 125 because increased weight enhances stability of the system.

Hydrodynamic features of the dive wing 125 include as design parameters, for example, angle of attack, degree of wing concavity, foldback angle of keels 312, and overall surface area of the dive wing 125. Utilizing well established fluid dynamic principles the dive wing 125 can be parametrically designed to provide a shape that optimizes lift and drag for a given application so that when deployed, the attached cables 110 meet the water behind the ship 103 in a flat, non-turbulent zone behind the wake of ship 103, and at a useful angle for safe deployment of the watercraft. Exemplary specifications are summarized below:

Exemplary Case:

Ship

Top speed . . . 20 m/sec

Bollard pull of 22300 kg at . . . 7.5 m/sec

To generate 11000 kg of dive force,

Surface area of dive wing at 7.5 m/sec . . . 1.5 to 2.5 $m^2$

Soft Rail Width between cables . . . 3 m

Scope Ration . . . 2/1

Total length of soft rail line . . . 28 m

Tow Speed . . . 7.5 m/sec

Tow Point . . . 4 m above water level

Point where soft rail enters water . . . 8 m aft of launch point

Launch speed . . . 0.50 m/sec

Payload . . . 2300 kg

Drag . . . 22400 kg

Dive Force . . . 13200 kg

Dive Force/Drag Ratio . . . 0.59

Soft Rail tension . . . 26000 kg

Payload to Line tension ratio . . . 0.35

Additionally, the dive wing 125 has bilateral attachment points for cables 110 formed by cable attachment plates 305. Each cable attachment plate 305 has a convex bottom surface 317 that may be welded or otherwise attached to the concave side of the dive wing 125, preferably in an area of the dive wing 125 that is proximate to a corresponding dive wing keel 312.

As shown in FIGS. 3A and 3B, each cable attachment plate 305 is anvil shaped, having a concave leading edge 316 which joins the convex bottom surface 317. The concave leading edge 316 extends to join a concave top surface 318. The concave top surface 318 tapers to join the bottom surface 317 at a trailing edge of the plate 305.

The cable attachment points 310 have throughbores in a region of the plate 305 that is proximate to where the concave leading edge extends to join the concave top surface. Cable attachment hardware, such as anchor shackles 308, utilize the throughbores at cable attachment points 310 to provide secure fastening of the cables 110 to the dive wing 125.

A drogue attachment plate 320 has a substantially concave top edge 321 that is welded or otherwise attached to the convex side of the dive wing 125, and is disposed so that it directly opposes the cable attachment plate 305. A fin-like bottom surface of the drogue attachment plate 320 may have a convex bottom edge 322, as it extends below the dive wing 125. An aft section of the bottom edge 322 joins a drogue attachment plate trailing edge 324 that extends at an angle away from the dive wing 125.

The top edge 321 of the drogue attachment plate 320 extends downward from an upper trailing edge 303 of the dive wing 125 to join the trailing edge 324 of drogue attachment plate 320. Proximate and parallel to the trailing edge of the drogue attachment plate 320 are a plurality of throughbores 326, which are provided as attachment points for drogue attachment hardware.

The cables 110 are preferably one to two inches in diameter, and may be composed of strands of a durable synthetic polymer, e.g. nylon. Each cable 110 may be custom designed to withstand suitable tensions for any given payload. Braided ropes are preferable because of their resistance to twisting. Synthetic ropes with low elastic elongation do not have severe snap reaction when broken under high loads, enhancing the safety of the launch. Each of these ropes can be easily spliced by experienced personnel on board the launch vessel.

Higher strength synthetic ropes have nearly twenty years of working history in fishing fleets and have properties of high strength, high abrasion resistance and low weight, and thus are preferable for use as cables 110. In particular, the high molecular weight polyethylene ropes marketed under the trade names of Spectra® and Dynema® are suitable for use in the launch and recovery system 105.

Typical rope properties for use as cables 110 preferably include an ultrahigh molecular weight (UHMW) polyethylene composition having a specific gravity of 0.98, a percent stretch at 30% break load of 0.96%, a diameter of fifty-two millimeters, a breaking strength of 186,000 kg, and a weight per length of 162 kg/100 m.

Alternatively, the cables 110 may be composed of flexible and resilient stranded wire having similar properties to the aforementioned. A payload to line tension ratio may range up to approximately 0.35. The angle of attack of the cables 110 with respect to the water may range from approximately 30° (scope ratio of 2:1) for the steepest angle to approximately 5° (scope ratio of 11:1) for a shallower angle.

The length of lower rigging 127 to the length of upper rigging 126 may preferably approximate a ratio of 0.90. It should be noted that lower rigging 127 comprises a combination of cable tie off to the dive wing 125 and drogue tie off to dive wing 125 at bottom leading edge 142 of drogue 130. Upper rigging 126 ties off to cable 110 at a point anterior to the dive wing 125 and ties off to top of lateral nets 140 of the drogue 130.

Speed of the ship 103 generates drag on the drogue 130 and dive wing 125, which develop high tension in the cables 110. The cables 110 extend a distance dependent upon the launch height above water and the drogue depth while sloping downward behind the ship 103. In some instances where the cable angle is insufficient for a gravity launch, a secondary drogue device can be used to assist the deployment process. The watercraft 120 is held on the cables 110 by a sling carriage 115, which is removably attached to, and is capable of riding on, the taut cables 110.

Figure 4:
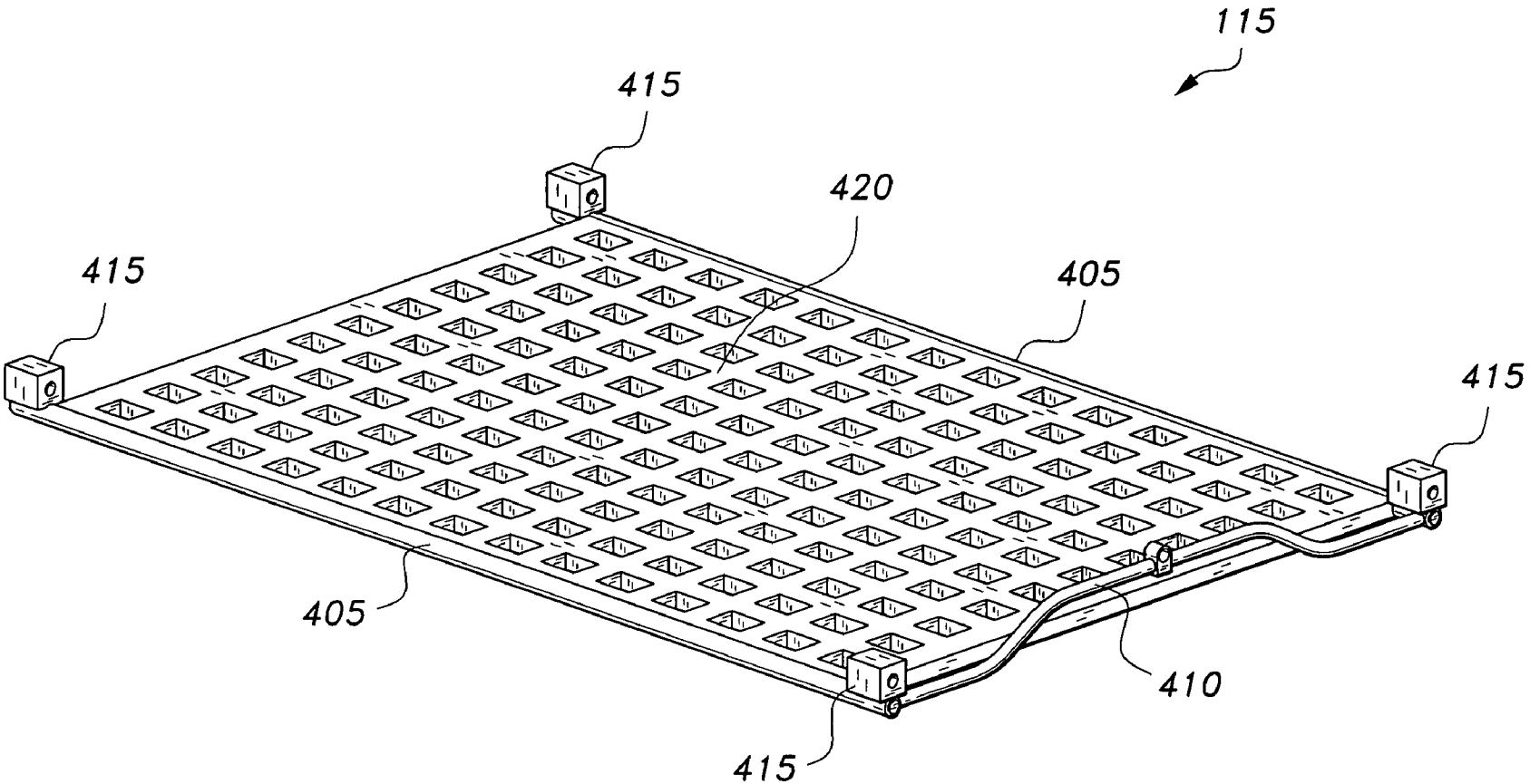
FIG. 4 is a perspective view of the sling carriage of a boat launch and recovery system according to the present invention.
Figure 5:
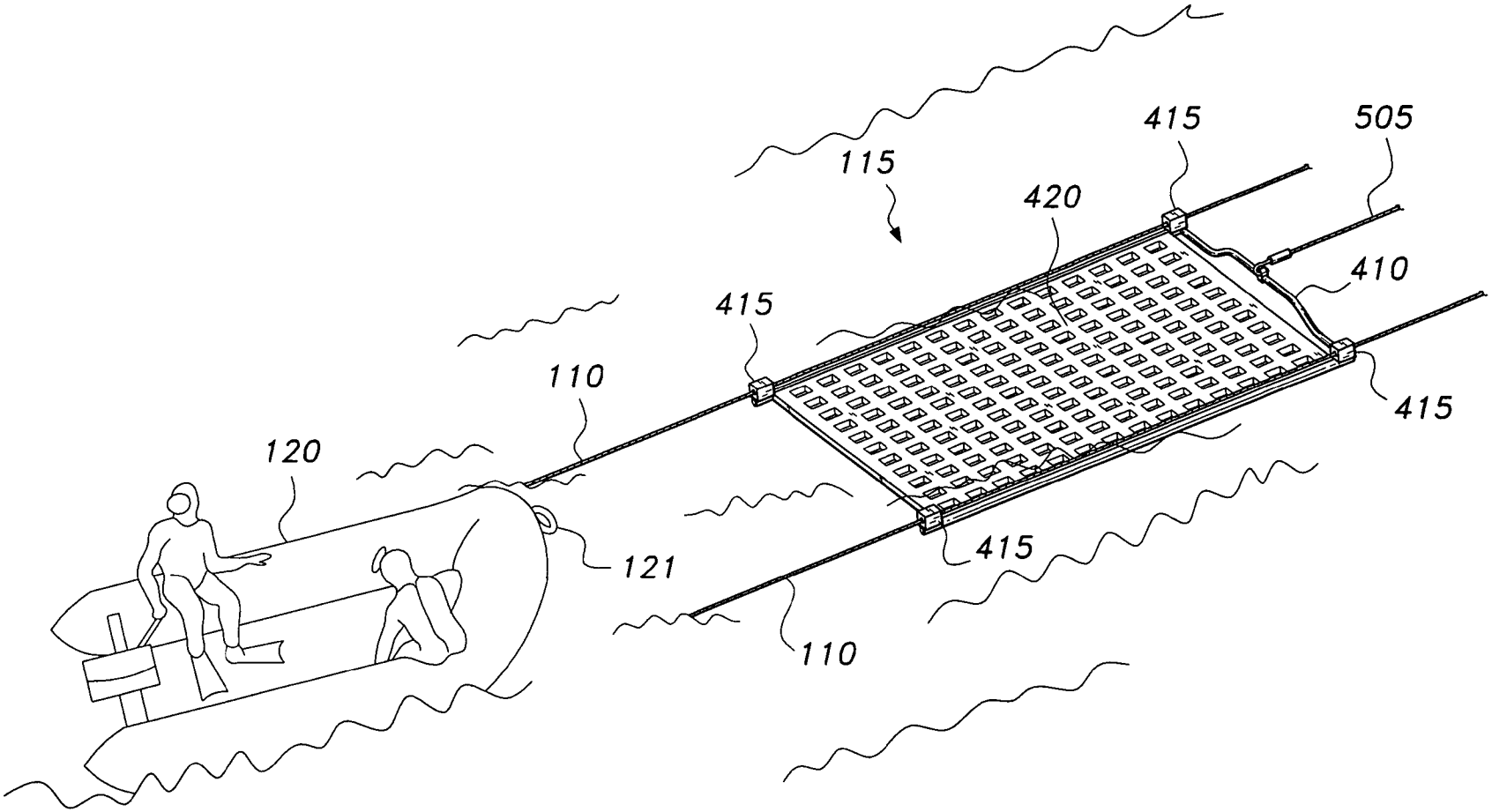
FIG. 5 is an environmental perspective view of a watercraft after being launched by a boat launch and recovery system according to the present invention.

As shown in FIG. 4, the sling carriage 115 includes resilient, or alternatively, rigid longitudinal frame members 405, anterior alignment bar 410, and a netted or strapped structure 420 that holds the watercraft 120 by friction between the netted structure 420 and the watercraft 120. Guide rollers 415 having slide bores form a removable attachment to the cables 110, and are disposed at the corners of the sling carriage 115.

Optionally, the watercraft 120 may be held in place by capture rollers (not shown) disposed longitudinally along the sides of the sling carriage 115. Deployment of the watercraft 120 is achieved by releasing the sling carriage 115, which carries the watercraft 120 along the cables 110 and into the water behind the ship 103. The sling carriage 115 continues underwater where it reaches stops disposed on the cables 110. Thus, the watercraft 120 is automatically free of the sling carriage 115 when the watercraft 120 hits the water, thereby completing the launch process. According to the present invention, when the payload drop is from four meters above the water, payload trajectory speed may range from approximately twenty meters per second to approximately twelve meters per second, depending upon the payload weight, which may range from under 1,000 kg to over 20,000 kg.

Recovery of the watercraft 120 from the water is accomplished by capturing a ball and recovery line 111 that is passed through a guide in the alignment bar 410 of sling carriage 115 and allowed to play out thirty to fifty feet beyond the sling carriage. The end of line 111 is attached to a buoy. The crew of the watercraft 120 retrieve the end of the line 111 from the buoy and secure the captured line to the bow of watercraft 120 at a tow hook 121. Winch 102 pulls in the watercraft while aligning the watercraft 120 with the sling carriage 115 by means of the guide in alignment bar 410. The watercraft is pulled back aboard the sling carriage 115, and line 111 is winched to pull both sling carriage 115 and watercraft 120 back aboard ship 103. The split drum winches then pull cables 110, dive wing 125 and drogue 130 back aboard ship 103.

It is within the scope of the present invention that the various aforementioned dimensions and performance limitations of elements of the launch recovery system 105 may be modified by using simulation and analysis software such as, for example, the Numerical Engineering and Modeling of Ocean Systems (NEMOS) published at Illinois Institute of Technology (IIT).

Other modeling software allowing for dynamic and nonlinear element formulation, large deformations, fluid loading that includes the capability to simulate superimposed waves, current gradient, current shear, and having the capability to subject elements to pressure, wave and current loading may be utilized.

It is to be understood that the present invention is not limited to the embodiment described above, but encompasses any and all embodiments within the scope of the following claims.

I claim:

1. A launch and recovery system, comprising:

a foil configured to form a dive wing adapted to dive in water;

a drogue attached to the dive wing;

at least one cable attached to the dive wing, the cable being adapted for being played out from a launch mechanism mounted on a ship; and a sling carriage slidably mounted on the at least one cable, the sling carriage being adapted for carrying a watercraft;

wherein the at least one cable is played out from the ship while underway to drag the dive wing and drogue underwater in order to apply tension to the at least one cable for sliding the sling carriage down the cable to launch the watercraft in the wake of the ship while the ship is underway.

2. The launch and recovery system according to claim 1, further comprising a recovery winch adapted for mounting on the stern of the ship, the recovery winch having a recovery line being attached to the sliding carriage and alternately adapted for attachment to the watercraft, whereby the sliding carriage is retrieved after launch by operation of the recovery winch, and the sliding carriage and watercraft are retrieved after use by operation of the recovery winch.

3. The launch and recovery system according to claim 1, further comprising a plurality of guide rollers attached to said sliding carriage, the guide rollers being slidably disposed on said at least one cable.

4. The launch and recovery system according to claim 1, wherein said diving wing comprises an intermediate, elongate foil member and a pair of keels extending rearward from opposite ends of the intermediate foil member.

5. The launch and recovery system according to claim 4, wherein the intermediate foil member has a concave leading edge.

6. The launch and recovery system according to claim 4, wherein the keels extend rearward from the intermediate foil member at an angle of about 20°.

7. The launch and recovery system according to claim 4, wherein each of the keels has a tapered trailing edge.

8. The launch and recovery system according to claim 4, wherein a ratio of an overall span of the dive member to the span of the intermediate foil member is approximately 1.336 to 1.

9. The launch and recovery system according to claim 1, wherein said dive wing is made of steel.

10. The launch and recovery system according to claim 1, wherein said at least one cable has a diameter of between about one to two inches, is formed from braided strands of a durable synthetic polymer, and has sufficient strength to withstand a tension of up to about 26,000 kg.

11. The launch and recovery system according to claim 1, wherein said at least one cable comprises a pair of cables adapted for attachment to a split drum winch.

* * * * *